United States Patent [19]

Seufert

[11] 4,170,836

[45] Oct. 16, 1979

[54] PICTURE FRAME MAT

[76] Inventor: Ludwig Seufert, Sonnleite 33, 8702 Lengfeld, Fed. Rep. of Germany

[21] Appl. No.: 867,317

[22] Filed: Jan. 5, 1978

[30] Foreign Application Priority Data

Apr. 27, 1977 [DE] Fed. Rep. of Germany ... 7713250[U]

[51] Int. Cl.[2] ..... G09F 1/10

[52] U.S. Cl. ..... 40/158 R

[58] Field of Search ..... 40/158 R, 158 B, 154, 40/152

[56] References Cited

U.S. PATENT DOCUMENTS

| | | | |
|---|---|---|---|
| 236,244 | 1/1881 | Nurre | 40/158 R |
| 268,870 | 12/1882 | Currier | 40/152 |
| 1,032,515 | 7/1912 | Sterrick | 40/154 |
| 2,458,349 | 1/1949 | Cross | 40/158 R |
| 2,984,030 | 5/1961 | Hannon | 40/2.2 |
| 3,522,673 | 8/1970 | Dudley | 40/158 R |
| 3,679,512 | 7/1972 | Macone | 40/2.2 |
| 3,789,529 | 2/1974 | Thom | 40/158 R |
| 3,873,342 | 3/1975 | Ellison | 40/158 R |

FOREIGN PATENT DOCUMENTS

| | | | |
|---|---|---|---|
| 626756 | 5/1927 | France | 40/158 R |

*Primary Examiner*—Russell R. Kinsey
*Assistant Examiner*—Wenceslao J. Contreras
*Attorney, Agent, or Firm*—Staas & Halsey

[57] ABSTRACT

A picture frame assembly having a reinforcing insert sandwiched between two interconnected plastic layers with a plastic sheet bearing a graphic presentation being affixed to the front surface of one of the two plastic layers.

2 Claims, 3 Drawing Figures

Fig.1
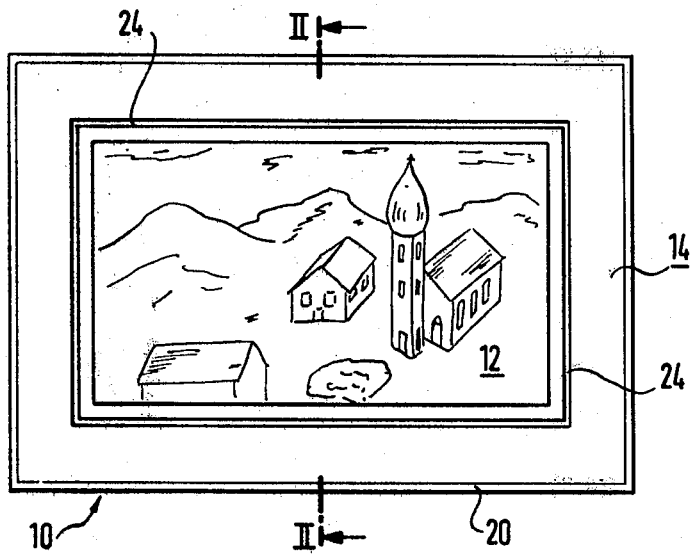
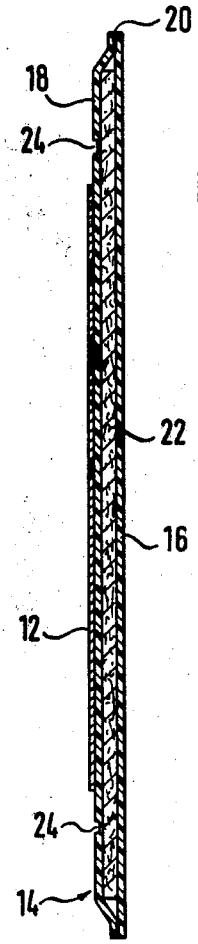
Fig.2

PICTURE FRAME MAT

FIELD OF THE INVENTION

The invention relates to a picture frame assembly containing a plastic sheet having a surface bearing a graphic presentation affixed to a picture carrier formed from a reinforcing insert sandwiched between two interconnected plastic layers.

DESCRIPTION OF THE PRIOR ART

Normally a picture frame assembly consists of a picture frame into which a graphic presentation may be inserted in a form of a picture plate or sheet with the picture plate or sheet normally being inserted behind a sheet of glass. However, such a picture frame assembly is generally quite complicated in construction from the viewpoint of production engineering and is therefore quite expensive to produce.

SUMMARY OF THE INVENTION

The object of the invention is to create a picture frame consisting of a reinforcing insert sandwiched between two interconnected plastic layers with a plastic sheet bearing a graphic presentation being affixed to the front surface of one of the two aforementioned plastic layers. In such a fashion, an inexpensive, easily produced picture frame may be constructed.

Another object of the invention is to produce a picture frame as above wherein a framing strip may be impressed into the surface of the plastic layer to which the plastic sheet bearing the graphic presentation is affixed.

A further object of the invention is to construct a picture frame assembly as above in which all of the parts may be interconnected by a single operation simultaneously with the impression of the framing strip.

A further object of the invention is to produce a picture frame as above with an additional insert sandwiched between the outside perimeter of the reinforcing insert and the plastic layer to which the plastic sheet bearing the graphic presentation is affixed so as to enable the outside perimeter of the plastic layer to stand out from the graphic presentation.

BRIEF DESCRIPTION OF THE DRAWINGS

FIG. 1 illustrates a front view of a picture frame assembly according to the present invention.

FIG. 2 illustrates a sectional view of FIG. 1 taken along the plane II—II of FIG. 1.

DESCRIPTION OF THE PREFERRED EMBODIMENT

Figure 3:
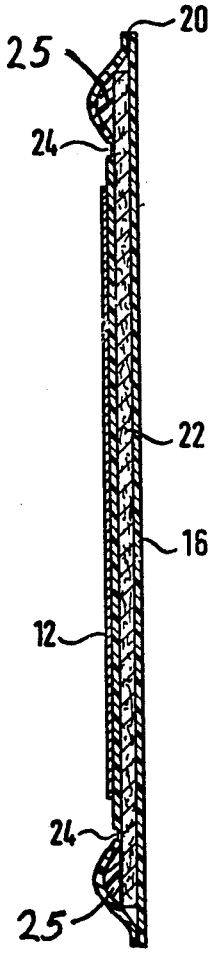
FIG. 3 illustrates a sectional view of FIG. 1 taken along the plane II—II showing an additional embodiment of the present invention.

As illustrated in FIGS. 1 and 2, the present invention consists of a picture frame assembly 10 consisting of a plastic sheet 12 bearing a graphic presentation and a picture carrier 14. The picture carrier 14 is composed of three components, namely: a back plastic layer 16 which may be made of a foil material and a front plastic layer 18 which may also be made of a foil material. Both plastic layers 16 and 18 are welded together at their edge 20. Between the two plastic layers 16 and 18, there is a reinforcing insert 22. The front plastic layer 18 may also have an impressed framing strip 24 arranged outside the plastic sheet 12. The plastic sheet 12 may be affixed to the front plastic layer 18 using a suitable adhesive. The reinforcing insert may be made of cardboard while the plastic sheet may be made of a hard PVC plastic material.

The assembly consisting of the two plastic layers 16 and 18 and the reinforcing insert 22 is produced in a single operation by welding together the two plastic layers 16 and 18 with the reinforcing insert 22 sandwiched inbetween. The framing strip 24 or other decorations may be formed simultaneously with the welding process under the effect of heat and pressure. Subsequently, the plastic picture sheet 12 is affixed to the front of plastic layer 18.

In another additional embodiment as illustrated in FIG. 3, a plastic insert 25 which may of a foam PVC material may be pushed inbetween the reinforcing insert 22 and the front plastic layer 18 in the area outside the plastic picture sheet 12 prior to the welding operation such that the outside perimeter edge of the picture frame stands out from the picture sheet 12.

While preferred forms arrangements have been shown in illustrating the invention, it is to be clearly understood that various changes and detailed arrangement may be made without department from the spirit and scope of this disclosure.

What is claimed is:

1. A picture frame comprising a plastic sheet having a surface bearing a graphic presentation and further comprising a picture carrier comprising first and second interconnected plastic layers and a reinforcing insert sandwiched therebetween;

wherein the first and second plastic layers are welded together at least at the edges and whereby a closed framing strip is impressed in the first plastic layer;

wherein said plastic sheet bearing the graphic presentation is affixed to the first plastic layer inside the impressed framing strip;

and wherein an additional plastic insert is arranged between said first plastic layer and said reinforcing insert such that said plastic insert is outside the area of the plastic sheet bearing the graphic presentation.

2. A picture frame as in claim 1, wherein the plastic sheet bearing the graphic presentation is of a hard PVC material.

* * * * *